US006801737B2

(12) United States Patent
Yanagida

(10) Patent No.: US 6,801,737 B2
(45) Date of Patent: Oct. 5, 2004

(54) IMAGE FORMING APPARATUS INCLUDING AN IMAGE CARRIER DRIVING MECHANISM

(75) Inventor: Masato Yanagida, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/352,062

(22) Filed: Jan. 28, 2003

(65) Prior Publication Data

US 2003/0161663 A1 Aug. 28, 2003

(30) Foreign Application Priority Data

Jan. 28, 2002 (JP) ..... 2002-018749
Dec. 27, 2002 (JP) ..... 2002-381426

(51) Int. Cl.[7] ..... G03G 15/00
(52) U.S. Cl. ..... 399/167
(58) Field of Search ..... 74/665 GA, 665 GB, 74/665 GD, 665 GE; 399/117, 167

(56) References Cited

U.S. PATENT DOCUMENTS 5,905,927 A * 5/1999 Inoue et al. ..... 399/167

FOREIGN PATENT DOCUMENTS

| | | |
|---|---|---|
| JP | 2745599 | 6/1990 |
| JP | 06-266175 | 9/1994 |
| JP | 09-081006 | 3/1997 |
| JP | 10-307506 | 11/1998 |
| JP | 2000-098690 | 4/2000 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus including an image carrier rotatably provided therein for carrying an image on a circumferential surface of the image carrier, at least one exposure device for exposing exposure positions on the circumferential surface of the image carrier with light, a drive device for driving the image carrier to rotate, a first meshing member positioned to rotate coaxially and unitarily with the image carrier, a second meshing member positioned to convey a drive force generated by the drive device to the first meshing member by direct meshing engagement with the first meshing member or a timing belt spanned around the first and second meshing members. The first meshing member has teeth between first and second exposure positions of the exposure positions, the teeth on the first meshing member has a number of teeth which is an integer multiple of a number of teeth on the second meshing member.

17 Claims, 7 Drawing Sheets

IMAGE FORMING APPARATUS INCLUDING AN IMAGE CARRIER DRIVING MECHANISM

CROSS-REFERENCE TO RELATED APPLICATIONS

The present application claims priority to Japanese Patent Application No. 2002-018749 filed in the Japanese Patent Office on Jan. 28, 2002 and Japanese Patent Application No. 2002-381426 filed in the Japanese Patent Office on Dec. 27, 2002, the disclosures of which are hereby incorporated by reference herein in their entirety.

BACKGROUND OF THE INVENTION

1. Field of the Invention

The present invention relates to an electrophotographic color image forming apparatus such as a copying machine, a printer, a facsimile machine, or a multi-functional image forming apparatus, and more particularly to an image carrier driving mechanism that drives an image carrier in the image forming apparatus to rotate.

2. Discussion of the Background

A multi-color image forming apparatus that forms multi-color (two or more colors) images on a transfer material, such as a transfer sheet, and an overhead transparency film, includes two or more sets of charging devices, exposure devices, and developing devices around an image carrier. In such a multi-color image forming apparatus, an image forming process including charging, exposing, and developing steps is repeated while the image carrier is rotated, and toner images of different colors are superimposed upon each other on the image carrier. Subsequently, superimposed toner images are collectively transferred from the image carrier to a transfer material.

In the above-described multi-color image forming apparatus, a drive force of a drive motor serving as a drive device is conveyed to the image carrier via gears and/or a timing belt spanned around timing pulleys in an image carrier driving mechanism. However, in a multi-color image forming apparatus including such an image carrier driving mechanism, irregular rotation of the image carrier caused by the eccentricity and irregular shape of meshing members such as gears and timing pulleyscauses unevenness of image density and displacement of color images of toner images on a transfer material, thereby deteriorating image quality.

In order to solve the above-described problem, for example, Japanese Laid-open patent application No. 9-81006 describes a color image forming apparatus in which the timing of exposure performed by an image exposure device is controlled based on information of a rotational fluctuation of an image carrier.

Further, Japanese patent No. 2745599 describes a multi-color image recording apparatus in which each image forming unit is arranged at a position corresponding to the same phase of the rotary variation cycle of a transfer material carrier.

Moreover, Japanese Laid-open patent application No. 2000-98690 describes a multicolor image forming apparatus in which displacement of color images is prevented by regulating the number of teeth of gears in an image carrier driving mechanism.

However, the structure of the above-described background apparatus tends to be complicated.

SUMMARY OF THE INVENTION

According to one aspect of the present invention, an image forming apparatus includes an image carrier rotatably provided therein and configured to carry an image on a circumferential surface of the image carrier, at least one exposure device configured to expose a plurality of exposure positions on the circumferential surface of the image carrier with light, a drive device configured to drive the image carrier to rotate, a first meshing member positioned to rotate coaxially and unitarily with the image carrier, a second meshing member positioned to convey a drive force generated by the drive device to the first meshing member by one of a direct meshing engagement with the first meshing member and a timing belt spanned around the first and second meshing members. The first meshing member has a plurality of teeth between first and second exposure positions of the plurality of exposure positions, and the plurality of teeth on the first meshing member has a number of teeth which is an integer multiple of a number of teeth on the second meshing member.

According to another aspect of the present invention, an image forming apparatus includes an image carrier rotatably provided therein and configured to carry an image on a circumferential surface of the image carrier, at least one exposure device configured to expose a plurality of exposure positions on the circumferential surface of the image carrier with light, a drive device configured to drive the image carrier to rotate, a first meshing member positioned to rotate coaxially and unitarily with the image carrier, second meshing member positioned to convey a drive force generated by the drive device to the first meshing member via a timing belt spanned around the first and second meshing members, and a tension roller positioned to press against a surface of the timing belt to tension the timing belt. The timing belt has a conveyance distance between the first and second exposure positions, and the conveyance distance is an integer multiple of a peripheral length of the tension roller.

According to yet another aspect of the present invention, an image forming apparatus includes an image carrier rotatably provided therein and configured to carry an image on a circumferential surface of the image carrier, at least one exposure device configured to expose a plurality of exposure positions on the circumferential surface of the image carrier with light, a drive device configured to drive the image carrier to rotate, at least one pair of meshing members positioned to convey the drive force generated by the drive device to the image carrier, and a cleaning device configured to clean the circumferential surface of the image carrier while being driven by the drive device to slide in a longitudinal direction of the cleaning device. The image carrier is rotated between the first and second exposure positions for a time which is an integer multiple of a time for sliding the cleaning device by one reciprocating motion.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
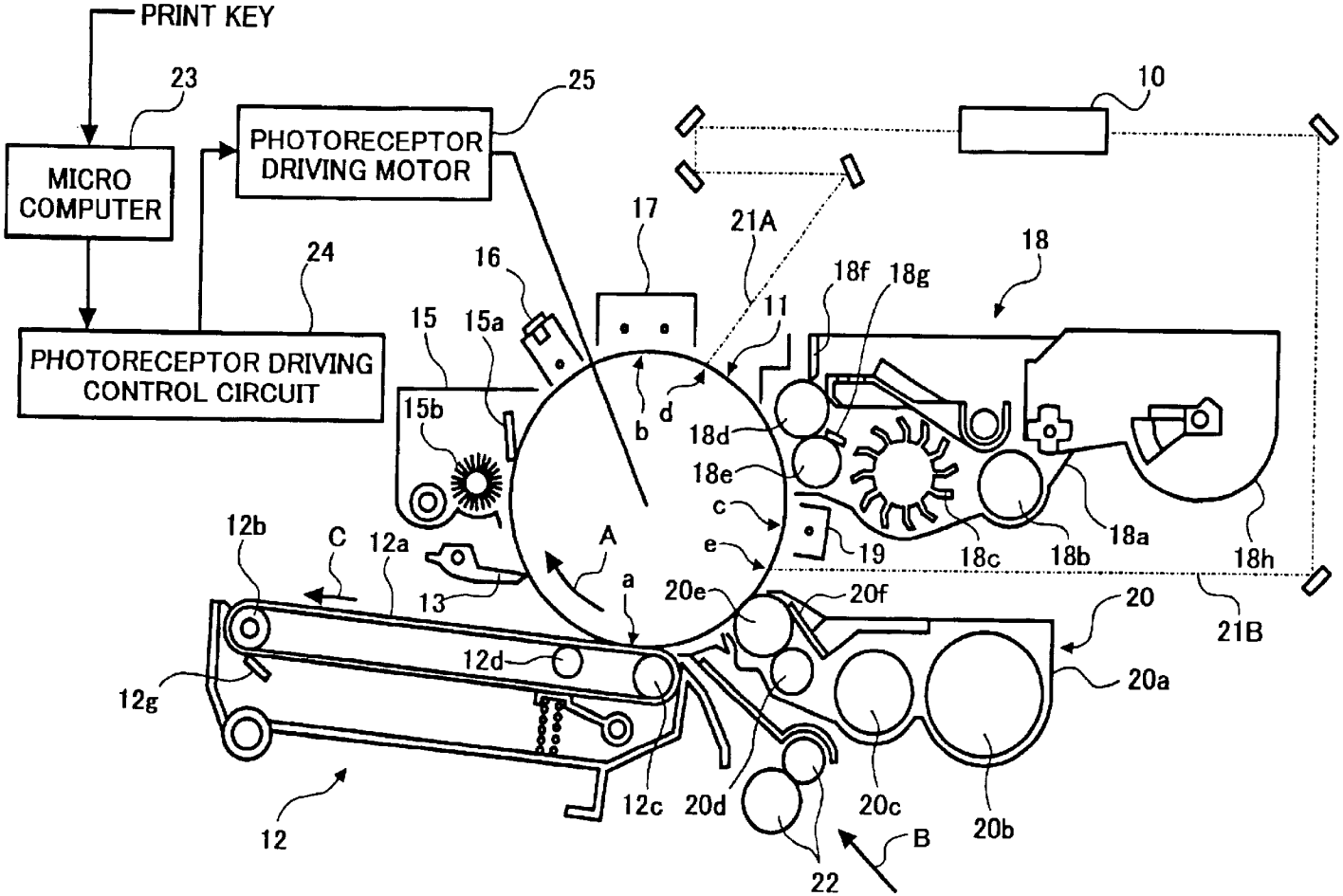
FIG. 1 is a schematic view of a two-color copying machine including an image carrier driving mechanism according to one embodiment of the present invention.

Preferred embodiments of the present invention are described in detail referring to the drawings, wherein like reference numerals designate identical or corresponding parts throughout the several views.

FIG. 1 is a schematic view of a two-color copying machine including an image carrier driving mechanism according to one embodiment of the present invention. The present invention can be applied not only to a copying machine, but also to similar image forming apparatuses such as a printer, a facsimile machine, etc. or a multi-functional image forming apparatus. Further, the present invention can be applied not only to a two-color image forming apparatus, but also to a multi-color image forming apparatus using three or more colors, a single-color image forming apparatus, etc.

The two-color copying machine of FIG. 1 includes a color scanner (not shown) at an upper part of a main body of the copying machine to scan an original document (not shown). Further, an auto document feeder (not shown, hereinafter referred to as an ADF) is attachable onto the color scanner.

In the two-color copying machine, the color scanner illuminates an original document to form an image of the original document. The color scanner further separates colors of light into two colors, e.g., black and red, and converts each of the separated colors into electric digital image signals.

The ADF sequentially feeds original documents onto an original document setting table of the color scanner for scanning the original documents by the color scanner. After the completion of scanning, the ADF discharges the original document from the original document setting table of the color scanner. Each of the electric digital image signals for black and red as image data undergoes a predetermined process at an image processing unit, and is then sent to an exposure device 10 as a laser writing device.

Referring to FIG. 1, in an image forming unit, an OPC photoreceptor drum 11 (hereinafter referred to as a photoreceptor 11) is employed as an image carrier. Arranged around the photoreceptor 11 are a first charging device 17, a first developing device 18, a second charging device 19, a second developing device 20, a transfer device 12, a separation pick 13, a photoreceptor cleaning device, 15 i.e., an image carrier cleaning device, and a discharging device 16 in the order of the rotational direction of the photoreceptor 11 as indicated by Arrow (A).

In the first developing device 18, a developer container 18*a* contains a color two-component developer including black toner and carrier. In the second developing device 20, a developer container 20*a* contains a color two-component developer including red toner and carrier.

The first charging device 17 and the exposure device 10 constitute a first latent image forming device forming a first latent image on the photoreceptor 11, and the second charging device 19 and the exposure device 10 constitute a second latent image forming device forming a second latent image on the photoreceptor 11.

Further, the first latent image forming device and first developing device 18 and the second latent image forming device and second developing device 20 constitute a toner image forming device which forms toner images on the photoreceptor 11, respectively.

A user sets an original color document on the original document setting table of the color scanner by hand or using the ADF. Then, the user selects a sheet size on an operation unit (not shown) and turns on a print key of the operation unit, thereby starting a copying operation. Upon starting the copying operation, the color scanner scans the original color document set on the original document setting table by colors, and converts each of the separated colors (black and red) into electric digital image signals.

In the image forming unit, the photoreceptor 11 is rotated in a direction indicated by Arrow (A) by a photoreceptor driving motor 25 serving as a drive device. A drive force is conveyed from the photoreceptor driving motor 25 to the photoreceptor 11 via an image carrier driving mechanism (described below).

While rotating the photoreceptor 11, the surface of the photoreceptor 11 is uniformly charged by the first charging device 17 at a first charging position (b) illustrated in FIG. 1. Then, the surface of the photoreceptor 11 is irradiated at a first exposure position (d) with a laser beam 21A emitted from the exposure device 10 in accordance with a black digital image signal sent from the image processing unit. As a result, an electrostatic latent image corresponding to a black component of the color image of the original document is formed on the photoreceptor 11, and then passes the position of the first developing device 18.

In the first developing device 18, a two-component developer including black toner and carrier contained in the developer container 18*a* is agitated by agitators 18*b*, 18*c* and is then supplied to developing rollers 18*d*, 18*e*. The developing rollers 18*d*, 18*e* magnetically attract the developer while rotating and carry their developer on the surfaces thereof.

The developer carried on the surfaces of the developing rollers 18*d*, 18*e* is regulated to a predetermined thickness by doctor blades, 18*f* 18*g*. While the developer passes through a gap between the developing rollers 18*d*/18*e* and the photoreceptor 11, black toner is transferred to the photoreceptor 11, and thereby a latent image on the photoreceptor 11 is developed with black toner. As a result, a black toner image is formed on the surface of the photoreceptor 11.

A toner replenishing device 18*h* replenishes the developer contained in the developer container 18*a* with black toner. The agitators 18*b*, 18*c* are rotated by a driving unit (not shown). The developing rollers 18*d*, 18*e* are connected to a driving unit (not shown) via a clutch to be rotated.

Further, after passing the position of the first developing device 18, the surface of the photoreceptor 11 is uniformly charged with the second charging device 19 at a second charging position (c) illustrated in FIG. 1. Then, the surface of the photoreceptor 11 is irradiated at a second exposure position (e) with a laser beam 21B emitted from the exposure device 10 in accordance with a red digital image signal sent from the image processing unit. Thereby, an electrostatic latent image corresponding to a red component of the color image of the original document is formed on the photoreceptor 11 such that the electrostatic latent image corresponding to the red component is superimposed on the above-described black toner image. Thereafter, the second developing device 20 develops the electrostatic latent image with red toner, thereby forming a red toner image. As a result, a two-color image composed of black and red toner images is formed on the photoreceptor 11.

In the second developing device 20, a two-component developer including red toner and carrier is agitated by agitators 20*b*, 20*c* and is conveyed to a developer supplying roller 20*d*. Then, the developer is supplied to a developing roller 20*e* by the developer supplying roller 20*d*. The developing roller 20*e* magnetically attracts the developer while rotating and carries the developer on its surface thereof.

The developer carried on the surface of the developing roller 20*e* is regulated to a predetermined thickness by a doctor blade 20*f*. While the developer passes through a gap between the developing roller 20*e* and the photoreceptor 11, the red toner is transferred to the photoreceptor 11, and thereby an electrostatic latent image on the photoreceptor 11 is developed with the red toner. As a result, a red toner image is formed on the surface of the photoreceptor 11. The agitators 20*b*, 20*c*, the developer supplying roller 20*d*, and the developing roller 20*e* are rotated by a driving unit (not shown).

A transfer material, such as a transfer sheet, an overhead transparency film of a sheet size selected by a user on the operation unit, etc., is fed from a sheet feeding cassette (not shown) to a pair of registration rollers 22 in a direction indicated by Arrow (B) in FIG. 1. The registration rollers 22 feed the transfer material to a transfer position (a) between the photoreceptor 11 and the transfer device 12 at such a timing that the two-color toner image on the photoreceptor 11 is aligned with the transfer material.

The transfer device 12 employs an endless transfer belt 12*a*. The transfer belt 12*a* is spanned around a drive roller 12*b*, a driven roller 12*c*, and a bias roller 12*d*. The drive roller 12*b* is rotated by a driving unit (not shown), thereby rotating the transfer belt 12*a*.

The transfer belt 12*a* contacts and separates from the photoreceptor 11 by a belt contact/separate mechanism (not shown). At the time of transferring a two-color toner image from the photoreceptor 11 to the transfer belt 12*a*, the transfer belt 12*a* is press-contacted to the photoreceptor 11. Otherwise, the transfer belt 12*a* is away from the photoreceptor 11.

A high voltage power supply serving as a charge applying device applies a charge to the transfer belt 12*a* at the time of the transferring by applying a transfer bias to the transfer belt 12*a* via the bias roller 12*d* serving as a transfer electrode. The transfer belt 12*a* conveys the transfer material fed from the registration rollers 22. After the two-color toner image on the photoreceptor 11 is electrostatically transferred to the transfer material at the transfer position (a) by applying the transfer bias to the transfer belt 12*a*, the transfer material is separated from the photoreceptor 11 and is conveyed in a direction indicated by Arrow (C) in FIG. 1. When the transfer material is not separated from the photoreceptor 11, the separation pick 13 separates the transfer material from the photoreceptor 11. The separated transfer material is conveyed by the transfer belt 12*a*.

The transfer material separated from the photoreceptor 11 is further separated from the transfer belt 12*a* at the position of the drive roller 12*b*. Thereafter, the toner image carried on the transfer material is fixed thereon by a fixing device (not shown). The transfer material with the fixed toner image is discharged from the main body of the copying machine by discharging rollers (not shown).

After the surface of the photoreceptor 11 passes the separation pick 13, the photoreceptor cleaning device 15 removes toner remaining on the photoreceptor 11 by a cleaning blade 15*a*, for example, an elastic member made of polyurethane rubber, and by a cleaning brush 15*b*. Subsequently, the surface of the photoreceptor 11 is discharged by the discharging device 16.

Although not shown, a seal member such as a MYLAR is provided at the entrance of the photoreceptor cleaning device 15. The leading edge of the seal member is made to contact the photoreceptor 11 to prevent the removed toner from leaking from the photoreceptor cleaning device 15.

A transfer belt cleaning device includes a cleaning blade 12*g* made of an elastic member and cleans the transfer belt 12*a*. The cleaning blade 12*g* is provided downstream from the transfer material separating position where the transfer material is separated from the transfer belt 12*a* in the rotational direction of the transfer belt 12*a*, thereby removing residual toner from the transfer belt 12*a*.

The above-described copying operation starts upon turning on (pressing) a print key, and is consecutively repeated a predetermined number of times in accordance with a number of copy sheets set by a user on the operation unit. When a single-color (i.e., black) copy mode is selected on the operation unit, only a black toner image is formed on the photoreceptor 11 without operating the second charging device 19, and the second developing device 20. In this case, the color scanner scans a black component of a color image of an original document set on the original document setting table of the color scanner. The color scanner further converts the scanned black component into electric digital image signals. The exposure device 10 exposes the surface of the photoreceptor 11 with the laser beam 21A in accordance with a black digital image signal. As a result, a single-color (black) copy is obtained.

The above-described copying machine includes a microcomputer 23 serving as a control device. When the print key is turned on, a print signal is input to the microcomputer 23. When a predetermined time (t1) elapses after the print signal is input to the microcomputer 23, the microcomputer 23 inputs an instruction for starting rotation of the photoreceptor 11 to a photoreceptor driving control circuit 24. After the instruction for rotating the photoreceptor 11 is input to the photoreceptor driving control circuit 24, the photoreceptor driving control circuit 24 generates a drive signal to drive the photoreceptor driving motor 25, and thereby the photoreceptor 11 is driven to rotate.

Figure 2A:
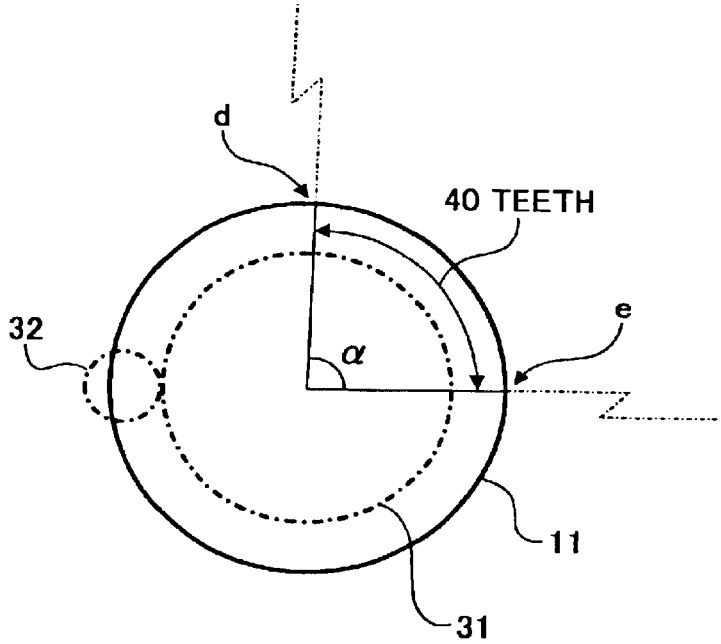
FIG. 2A is a side view of a photoreceptor driving mechanism in the two-color coping machine of FIG. 1.
Figure 2B:
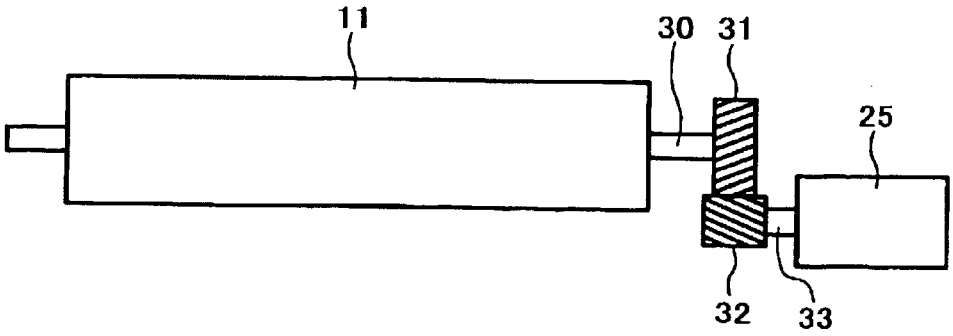
FIG. 2B is a top plan view of the photoreceptor driving mechanism.

FIG. 2A is a side view of a photoreceptor driving mechanism in the two-color coping machine of FIG. 1, and FIG. 2B is a top plan view of the photoreceptor driving mechanism. As illustrated in FIG. 2B, a photoreceptor gear 31 functioning as a first meshing member is provided on a drive shaft 30 of the photoreceptor 11 such that the photoreceptor gear 31 rotates coaxially and unitarily with the photoreceptor 11 about the drive shaft 30. Further, a motor gear 32 functioning as a second meshing member is engaged with the photoreceptor gear 31. The motor gear 32 is provided on a drive shaft 33 of the photoreceptor driving motor 25 such that the motor gear 32 rotates unitarily with the photoreceptor driving motor 25.

The drive shaft 33 is driven to rotate by the photoreceptor driving motor 25. The drive force of the photoreceptor driving motor 25 is conveyed to the drive shaft 30 via the drive shaft 33, the motor gear 32, and the photoreceptor gear 31, thereby driving the photoreceptor 11 to rotate.

In this embodiment, the number of teeth provided on the motor gear 32 is set to 10. Further, a rotation angle between the first exposure position (d) and the second exposure position (e) on the photoreceptor 11 is indicated by Reference Character ($\alpha$) as illustrated in FIG. 2A, and the number of teeth on the photoreceptor gear 31 provided in the range of the rotation angle ($\alpha$) is set to 40 which is the number of teeth on the motor gear 32, i.e., 10, multiplied by 4, an integer. The entire number of teeth on the photoreceptor gear 31 is set to 160 which is the number of teeth on the motor gear 32, i.e., 10, multiplied by 16, an integer. Thus, the photoreceptor 11 is rotated by the photoreceptor driving mechanism including the photoreceptor driving motor 25 in which the numbers of teeth on the photoreceptor gear 31 and motor gear 32 have a ratio which is set to be an integer.

By setting the numbers of teeth on the photoreceptor gear 31 and motor gear 32 as above, phases of the speed variation cycle between the two exposure positions (d), (e) are made coincident with each other with a simple construction of the apparatus. Thus, even though irregular rotation of the photoreceptor 11 is caused by the eccentricity and irregular shape of meshing members such as the photoreceptor gear 31 and the motor gear 32, a high quality image can be formed without occurrence of unevenness of image density and displacement of color images of toner images on a transfer material.

When the photoreceptor gear 31 and the motor gear 32 are formed from helical gears as illustrated in FIG. 2B, as compared to a spur gear, the gears can be smoothly engaged with each other, thereby suppressing impact and increasing accuracy. As a result, a high quality image can be obtained without occurrence of unevenness of image density and displacement of color images of toner images on a transfer material, while making phases of the speed variation cycles between two exposure positions (d), (e) coincident with each other.

Figure 3A:
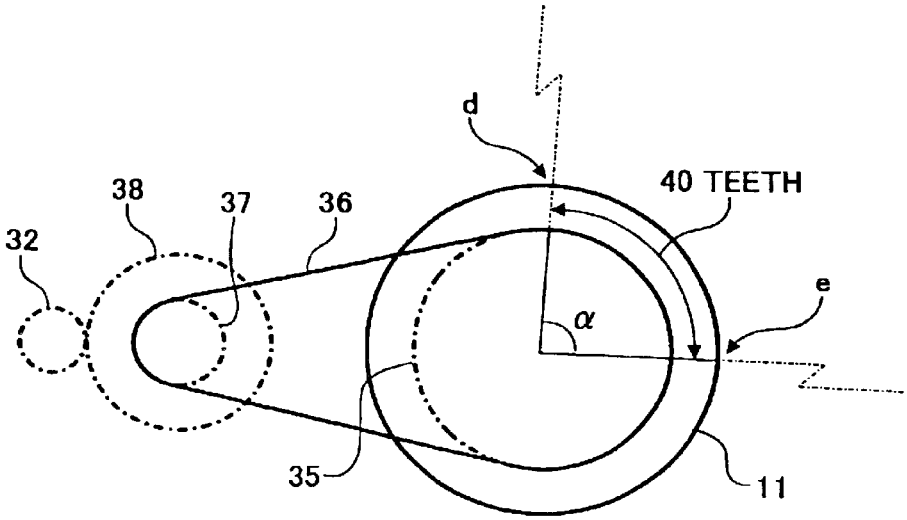
FIG. 3A is a side view of a photoreceptor driving mechanism in the two-color coping machine of FIG. 1 according to another embodiment of the present invention.
Figure 3B:
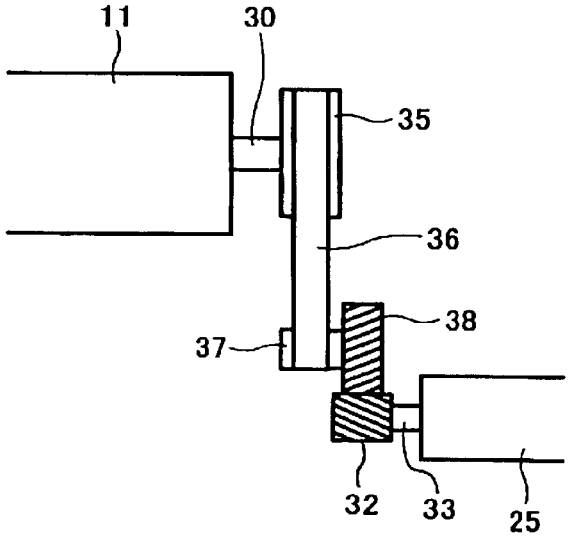
FIG. 3B is a top plan view of the photoreceptor driving mechanism of FIG. 3A.

FIG. 3A is a side view of a photoreceptor driving mechanism in the two-color coping machine of FIG. 1 according to another embodiment of the present invention, and FIG. 3B is a top plan view of the photoreceptor driving mechanism of FIG. 3A.

As illustrated in FIG. 3B, a photoreceptor timing pulley 35 functioning as a first meshing member is provided on the drive shaft 30 of the photoreceptor 11 such that the photoreceptor timing pulley 35 rotates coaxially and unitarily with the photoreceptor 11 about the drive shaft 30. Further, a timing belt 36 is spanned around the photoreceptor timing pulley 35 and a timing pulley 37 functioning as a second meshing member. A speed reducing gear 38 is coaxially provided on the timing pulley 37. The motor gear 32 is engaged with the speed reducing gear 38. The motor gear 32 is provided on the drive shaft 33 of the photoreceptor driving motor 25 such that the motor gear 32 rotates unitarily with the photoreceptor driving motor 25.

The drive shaft 33 is driven to rotate by the photoreceptor driving motor 25. The drive force of the photoreceptor driving motor 25 is conveyed to the drive shaft 30 via the drive shaft 33, the motor gear 32, the speed reducing gear 38, and the timing belt 36 stretched between the timing pulleys 35, 37, thereby driving the photoreceptor 11 to rotate.

In this embodiment, the number of teeth on the motor gear 32 is set to 10, and the number of teeth on the speed reducing gear 38 is set to 120, which is the number of teeth on the motor gear 32, i.e., 10, multiplied by 12, an integer. Further, the number of teeth on the timing pulley 37 is set to 40, and the number of teeth on the photoreceptor timing pulley 35 is set to 160, which is the number of teeth on the timing pulley 37, i.e., 40, multiplied by 4, an integer. That is, the numbers of teeth on the speed reducing gear 38 and the photoreceptor timing pulley 35 provided at a driven side are the numbers of teeth on the motor gear 32 and the timing pulley 37 provided at a drive side multiplied by integers, respectively.

Moreover, a rotation angle between the first exposure position (d) and the second exposure position (e) on the photoreceptor 11 is indicated by Reference Character ($\alpha$) as illustrated in FIG. 3A, and the number of teeth on the photoreceptor timing pulley 35 in the range of the rotation angle ($\alpha$) is set to 40 which equals the number of teeth on the timing pulley 37 which conveys the drive force of the photoreceptor driving motor 25 to the photoreceptor timing pulley 35 via the timing belt 36. That is, the number of teeth on the photoreceptor timing pulley 35 in the range of the rotation angle ($\alpha$) is the number of teeth on the timing pulley 37 multiplied by 1, an integer.

Thus, the photoreceptor 11 is driven to rotate by the photoreceptor driving mechanism including the photoreceptor driving motor 25 in which a the numbers of teeth on the speed reducing gear 38 and motor gear 32 have a ratio which is set to be an integer, and the numbers of teeth on the photoreceptor timing pulley 35 and timing pulley 37 have a ratio which is set to be an integer.

By setting the numbers of teeth on the motor gear 32, the speed reducing gear 38, the photoreceptor timing pulley 35, and the timing pulley 37 as above, phases of the speed variation cycle between the two exposure positions (d), (e) are made coincident with each other with a simple construction of the apparatus. Thus, even though irregular rotation of the photoreceptor 11 is caused by the eccentricity and irregular shape of meshing members such as the motor gear 32, the speed reducing gear 38, and the timing pulleys 35, 37 provided between the drive shaft 33 of the photoreceptor driving motor 25 and the drive shaft 30 of the photoreceptor 11, a high quality image can be formed without occurrence of unevenness of image density and displacement of color images of toner images on a transfer material.

The photoreceptor driving mechanism illustrated in FIGS. 3A and 3B includes two pairs of meshing members, one pair of the photoreceptor timing pulley 35 and the timing pulley 37 and the other pair of the speed reducing gear 38 and the motor gear 32. Alternatively, the photoreceptor driving mechanism may include a plurality of pairs of meshing members, for example, three pairs or more, that convey the drive force of the photoreceptor driving motor 25 to the photoreceptor 11.

Further, as an alternative construction of the photoreceptor driving mechanism illustrated in FIGS. 3A and 3B, in place of the photoreceptor timing pulley 35 and the timing pulley 37, two gears engaged with each other may be used. Moreover, in place of the speed reducing gear 38 and the motor gear 32, two timing pulleys with a timing belt spanned around the two timing pulleys may be used.

Figure 4:
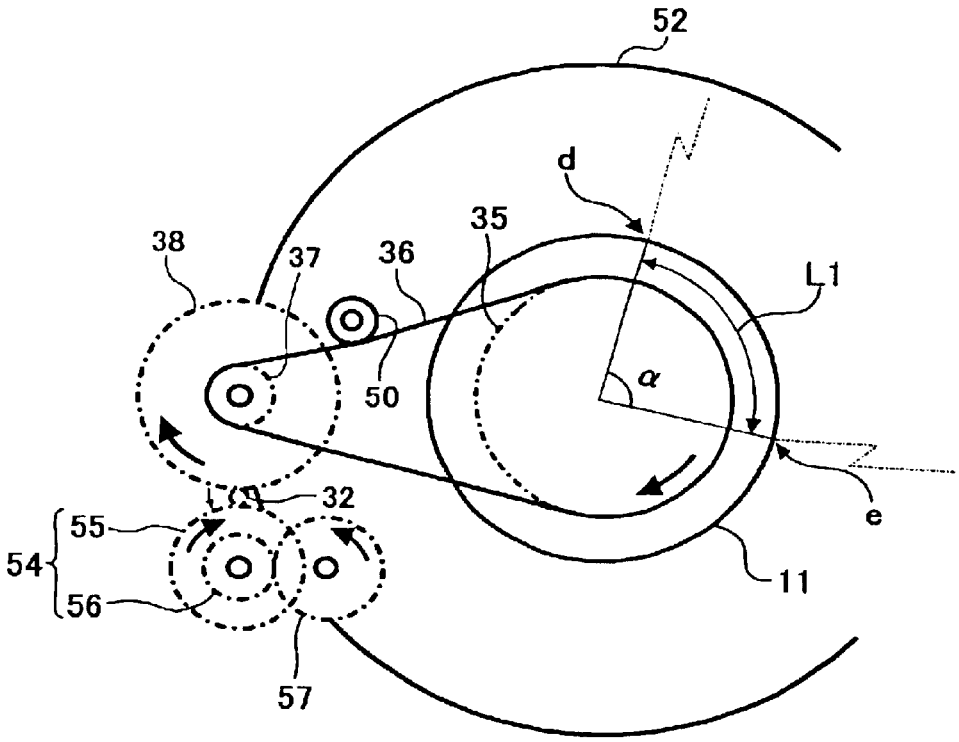
FIG. 4 is a side view of a photoreceptor driving mechanism as an alternative example of the photoreceptor driving mechanism of FIGS. 3A and 3B.

FIG. 4 is a side view of a photoreceptor driving mechanism as an alternative example of the photoreceptor driving mechanism of FIGS. 3A and 3B. Members having substantially the same functions as those in the photoreceptor driving mechanism illustrated in FIGS. 3A and 3B will be designated with the same reference characters and their description will be omitted.

In the photoreceptor driving mechanism of FIG. 4, the motor gear 32 is made by cutting teeth in the drive shaft 33 of the photoreceptor driving motor 25, and the number of teeth on the motor gear 32 is set to 9. The number of teeth on the speed reducing gear 38 is set to 108 which is the number of teeth on the motor gear 32, i.e., 9, multiplied by 12, an integer. Further, the number of teeth on the timing pulley 37 functioning as a second meshing member is set to 31, and the number of teeth on the photoreceptor timing pulley 35 functioning as a first meshing member is set to 217 which is the number of teeth on the timing pulley 37 multiplied by 7. Moreover, the number of teeth on the photoreceptor timing pulley 35 in the range of the rotation angle (α) between the exposure positions (d), (e) on the photoreceptor 11 is set to 31 which is the number of teeth on the timing pulley 37 multiplied by 1.

Referring to FIG. 4, a tension roller 50 presses against an outer surface of the timing belt 36 that conveys the drive force generated by the photoreceptor driving motor 25. Further, a conveyance distance (L1) of the timing belt 36 in the range of the rotation angle (α) between the exposure positions (d), (e) on the photoreceptor 11 is set to be a peripheral length (L2) of the tension roller 50 multiplied by an integer. Accordingly, the following relation is satisfied:

$$L1=m\times L2,$$

where "L1" is a conveyance distance of the timing belt 36 in the range of the rotation angle (α) between the exposure positions (d), (e) on the photoreceptor 11, and "L2" is a peripheral length of the tension roller 50, and "m" is a positive integer.

Further, a conveyance distance (L3) of the timing belt 36 conveyed by one rotation of the photoreceptor timing pulley 35 is set to be the peripheral length (L2) of the tension roller 50 multiplied by an integer. Accordingly, the following relation is satisfied:

$$L3=n\times L2,$$

where "L3" is a conveyance distance of the timing belt 36 conveyed by one rotation of the photoreceptor timing pulley 35, and "L2" is a peripheral length of the tension roller 50, and "n" is a positive integer.

By setting as above, phases of the speed variation cycle between the two exposure positions (d), (e) are made coincident with each other with a simple construction of the apparatus. Thus, even though irregular rotation of the photoreceptor 11 is caused by the eccentricity and irregular shape of meshing members such as the motor gear 32, the speed reducing gear 38, and the timing pulleys 35, 37 provided between the drive shaft 33 of the photoreceptor driving motor 25 and the drive shaft 30 of the photoreceptor 11, a high quality image can be formed without occurrence of unevenness of image density and displacement of color images of toner images on a transfer material.

The reduction ratio of the motor gear 32 and the speed reducing gear 38 is 1/12, and the reduction ratio of the timing pulley 37 and the photoreceptor timing pulley 35 around which the timing belt 36 is spanned is 1/7. Therefore, the reduction ratio of the motor gear 32 and the speed reducing gear 38 in direct meshing engagement is set to be greater than that of the timing pulley 37 and the photoreceptor timing pulley 35 connected to each other via the timing belt 36.

By setting the reduction ratio as above, phases of the speed variation cycle between the two exposure positions (d), (e) are made coincident with each other, and speed variation caused by the photoreceptor driving mechanism using a timing belt is suppressed and a speed is reduced smoothly. Thus, a high quality image can be formed without occurrence of unevenness of image density and displacement of color images of toner images on a transfer material.

Figure 5:
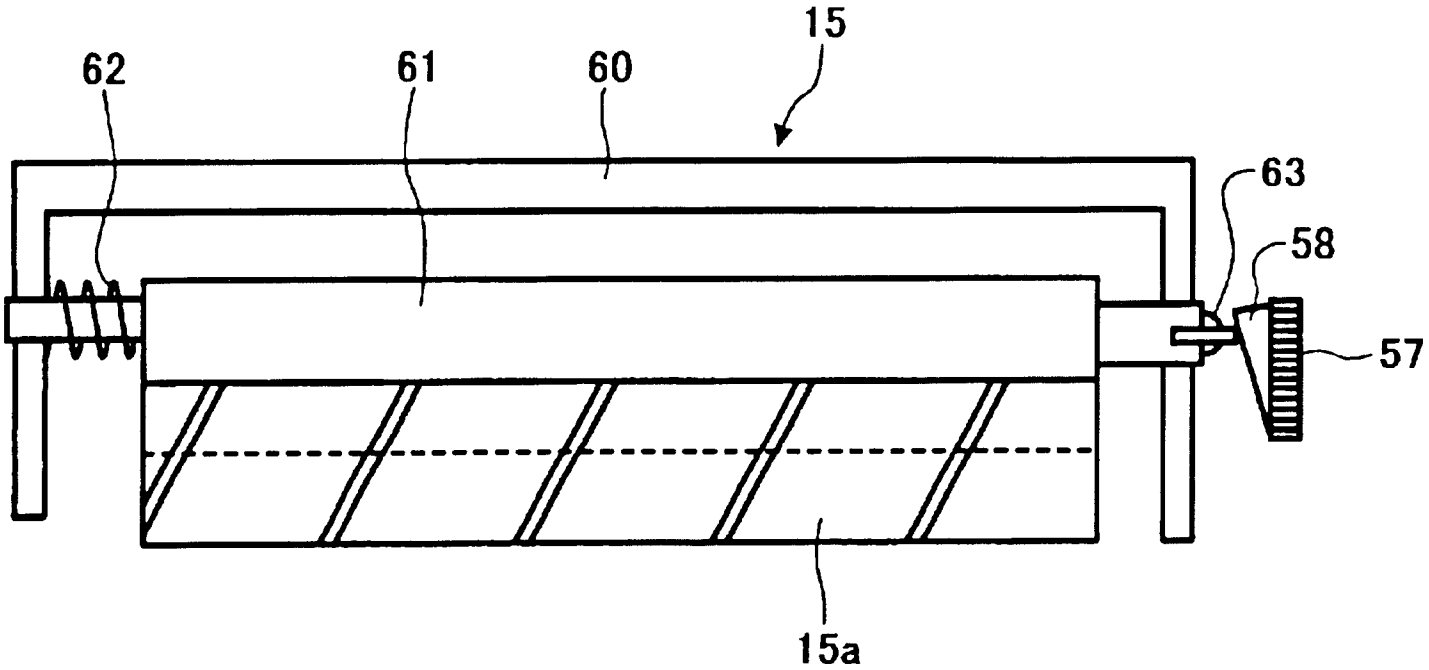
FIG. 5 is a schematic view of a photoreceptor cleaning device in the two-color coping machine of FIG. 1.

In FIG. 4, a reference numeral 52 represents a flywheel attached to the drive shaft 30 of the photoreceptor 11. In the image carrier driving mechanism of FIG. 4, the motor gear 32 is engaged with a large gear 55 in an intermediate gear 54. In the intermediate gear 54, a small gear 56 is coaxially provided with the large gear 55. The small gear 56 is engaged with a cam gear 57. As illustrated in FIG. 5, a face cam 58 is formed at the side surface of the cam gear 57. The face cam 58 may be shaped like an isosceles triangle, a right triangle, a sine curve, etc. The number of peaks on the cam is not limited to one but may be two or more.

Referring to FIG. 5, the reference numeral 60 represents a case of the photoreceptor cleaning device 15. The case 60 supports a cleaning holder 61 such that the cleaning holder 61 can slide in its longitudinal direction. The cleaning holder 61 holds the cleaning blade 15*a*. A spring 62 is provided between the one end of the cleaning holder 61 and the case 60 to bias the cleaning holder 61 rightward in FIG. 5, thereby pressing a ball bearing 63 provided at the other end of the cleaning holder 61 against the face cam 58.

With the above-described construction, when the photoreceptor driving motor 25 drives the photoreceptor 11, the drive force of the photoreceptor driving motor 25 is conveyed to the cam gear 57 via the motor gear 32 and the intermediate gears 54. With the rotation of the cam gear 57, the cleaning holder 61 slides, thereby sliding the cleaning blade 15*a*.

In the illustrated embodiment, it is set that a time for rotating the photoreceptor 11 from the first exposure position (d) to the second exposure position (e) is set to be a time for sliding the cleaning blade 15*a* by one reciprocating motion multiplied by an integer.

By this setting, the cleaning blade 15*a* is located at the same position on the surface of the photoreceptor 11 at the time of the first exposure and the second exposure operations. Because the condition of the photoreceptor 11 under the load of the cleaning blade 15*a* is not changed between the first and second exposure operations, the cleaning blade 15*a* does not exert a bad influence upon the first and second exposure operations. As a result, a high quality image free of offset color images can be obtained.

Figure 6:
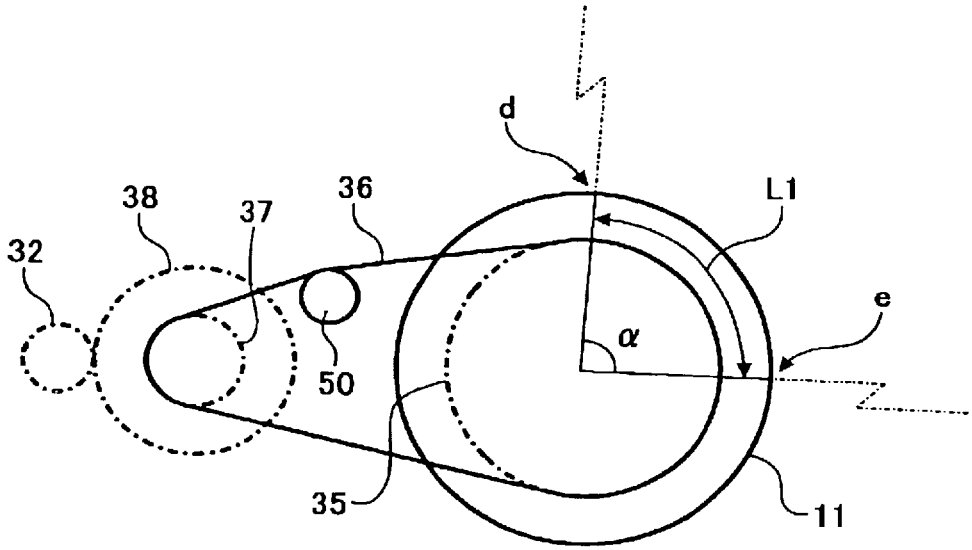
FIG. 6 is a side view of a photoreceptor driving mechanism as another alternative example of the photoreceptor driving mechanism of FIGS. 3A and 3B.

In the embodiment illustrated in FIG. 4, the tension roller 50 presses against the outer surface of the timing belt 36. Alternatively, as illustrated in FIG. 6, the tension roller 50 may press against the inner surface of the timing belt 36. Similarly, it is preferable that the conveyance distance (L1) of the timing belt 36 in the range of the rotation angle (α) between the exposure positions (d), (e) on the photoreceptor 11 is set to be the peripheral length (L2) of the tension roller 50 multiplied by an integer.

Figure 7:
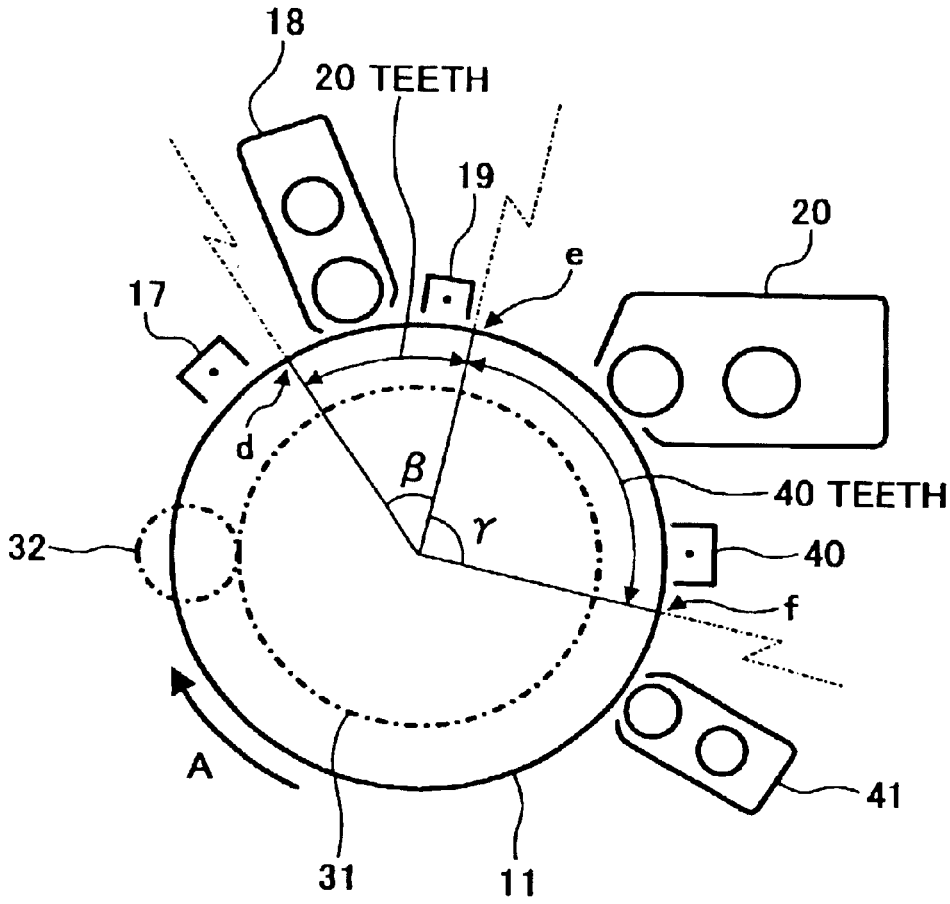
FIG. 7 is a schematic view of a three-color image forming apparatus including an image carrier driving mechanism according to another embodiment of the present invention.

FIG. 7 is a schematic view of a main construction of a color image forming apparatus which has three exposure positions (d), (e), (f) on the photoreceptor 11. Arranged around the photoreceptor 11 are the first charging device 17, a first exposure device (not shown), the first developing device 18, the second charging device 19, a second exposure device (not shown), the second developing device 20, a third charging device 40, a third exposure device (not shown), and a third developing device 41 in the order of the rotational direction of the photoreceptor 11 as indicated by Arrow (A).

The first developing device 18, the second developing device 20, and the third developing device 41 contain yellow, magenta, and cyan developers, respectively. A color toner image is formed on the photoreceptor 11 while superimposing yellow, magenta, and cyan developers upon each other.

Although not shown, as similarly in the two-color copying machine of FIG. 1, the color image forming apparatus of FIG. 7 includes the transfer device 12, the separation pick 13, the photoreceptor cleaning device 15, and the discharging device 16 around the photoreceptor 11. The drive force of a photoreceptor driving motor (not shown) serving as an image carrier drive device is conveyed to the photoreceptor 11 via the motor gear 32, and the photoreceptor gear 31 engaged with the motor gear 32, thereby rotating the photoreceptor 11. The motor gear 32 is provided onto a drive shaft of the photoreceptor driving motor, and the photoreceptor gear 31 is provided onto the drive shaft of the photoreceptor 11.

In this FIG. 7 embodiment, the number of teeth on the motor gear 32 is set to 10. Further, when a rotation angle indicated by Reference Character (β) between the first exposure position (d) and the second exposure position (e) on the photoreceptor 11 is set to 45 degrees, the number of teeth on the photoreceptor gear 31 extending in the range of the rotation angle (β),i.e., 45 degrees, is set to 20 which is the number of teeth on the motor gear 32, i.e., 10, multiplied by 2. Moreover, when a rotation angle indicated by Reference Character (γ) between the second exposure position (e) and the third exposure position (f) on the photoreceptor 11 is set to 90 degrees, the number of teeth on the photoreceptor gear 31 extending in the range of the rotation angle (γ),i.e., 90 degrees, is set to 40 which is the number of teeth on the motor gear 32, i.e., 10, multiplied by 4. The number of teeth on the photoreceptor gear 31 is set to 160 which is the number of teeth on the motor gear 32, i.e., 10, multiplied by 16.

Thus, the photoreceptor 11 is driven to rotate by the photoreceptor driving mechanism including the photoreceptor driving motor in which a ratio between the number of teeth on the photoreceptor gear 31 and the number of teeth on the motor gear 32 is set to be an integer.

The present invention has been described with respect to the embodiments as illustrated in figures. However, the present invention is not limited to the embodiments and may be practiced otherwise.

In the above illustrated embodiments, examples in which the present invention is applied to the color image forming apparatus having two exposure positions (d), (e) on the photoreceptor 11 and the color image forming apparatus having three exposure positions (d), (e), (f) on the photoreceptor 11 are described. However, the present invention can be also applied to a color image forming apparatus having plural exposure positions greater than three for developing respective exposed surfaces of the photoreceptor 11 with yellow, magenta, cyan, and black developers, for example.

Numerous modifications and variations of the present invention are possible in light of the above teachings. It is therefore to be understood that within the scope of the appended claims, the present invention may be practiced otherwise than as specifically described herein.

What is claimed is:

1. An image forming apparatus comprising:

an image carrier rotatably provided therein and configured to carry an image on a circumferential surface of the image carrier;

at least one exposure device configured to expose a plurality of exposure positions on the circumferential surface of th image carrier with light;

a drive device configured to drive the image carrier to rotate;

a first meshing member positioned to rotate coaxially and unitarily with the image carrier;

a second meshing member positioned to convey a drive force generated by the drive device to the first meshing member by one of a direct meshing engagement with the first meshing member and a timing belt spanned around the first and second meshing members; and at least one pair of meshing members positioned to convey the drive force generated by the drive device to the second meshing member, the at least one pair of meshing members connecting to each other by one of a direct meshing engagement and a second timing belt, wherein the first meshing member has a plurality of teeth between first and second exposure positions of the plurality of exposure positions, the plurality of teeth on the first meshing member has a number of teeth which is an integer multiple of a number of teeth on the second meshing member, the first and second meshing members have numbers of teeth whose ratio is an integer, and the meshing members of the at least one pair have numbers of teeth whose ratio is an integer.

2. The image forming apparatus according to claim 1, wherein the second meshing member conveys the drive force generated by the drive device to the first meshing member by the direct meshing engagement with the first meshing member, and the first and second meshing members comprise gears.

3. The image forming apparatus according to claim 2, wherein the gears comprise helical gears.

4. The image forming apparatus according to claim 1, wherein the second meshing member conveys the drive force generated by the drive device to the first meshing member by the timing belt, and the first and second meshing members comprise pulleys.

5. The image forming apparatus according to claim 1, wherein:

the at least one pair of meshing members include a third meshing member positioned to rotate coaxially and unitarily with the second meshing member and a fourth meshing member positioned to mesh with the third meshing member to convey the drive force generated by the drive device to the third meshing member;

the third and fourth meshing members comprise gears;

the second meshing member conveys the drive force generated by the drive device to the first meshing member by the timing belt; and the third and fourth meshing members have a reduction ratio which is greater than a reduction ratio of the first and second meshing members.

6. The image forming apparatus according to claim 1, wherein:

the second meshing member conveys the drive force generated by the drive device to the first meshing member by the direct meshing engagement with the first meshing member;

the at least one pair of meshing members include a third meshing member positioned to rotate coaxially and unitarily with the second meshing member and a fourth meshing member positioned to convey the drive force generated by the drive device to the third meshing member by a timing belt spanned around the third and fourth meshing members; and the first and second meshing members have a reduction ratio which is greater than a reduction ratio of the third and fourth meshing members.

7. An image forming apparatus comprising:

an image carrier rotatably provided therein and configured to carry an image on a circumferential surface of the image carrier;

at least one exposure device configured to expose a plurality of exposure positions on the circumferential surface of the image carrier with light;

a drive device configured to drive the image carrier to rotate;

a first meshing member positioned to rotate coaxially and unitarily with the image carrier;

a second meshing member positioned to convey a drive force generated by the drive device to the first meshing member via a timing belt spanned around the first and second meshing members; and a tension roller positioned to press against a surface of the timing belt to tension the timing belt, wherein the timing belt has a conveyance distance between the first and second exposure positions, and the conveyance distance is an integer multiple of a peripheral length of the tension roller.

8. The image forming apparatus according to claim 7, wherein:

the first meshing member comprises a pulley; and the conveyance distance is conveyed by one rotation of the first meshing member.

9. An image forming apparatus comprising:

an image carrier rotatably provided therein and configured to carry an image on a circumferential surface of the image carrier;

at least one exposure device configured to expose a plurality of exposure positions on the circumferential surface of the image carrier with light;

a drive device configured to drive the image carrier to rotate;

at least one pair of meshing members positioned to convey a drive force generated by the drive device to the image carrier; and a cleaning device configured to clean the circumferential surface of the image carrier while being driven by the drive device to slide in a longitudinal direction of the cleaning device, wherein the image carrier is rotated between the first and second exposure positions for a time which is an integer multiple of a time for sliding the cleaning device by one reciprocating motion.

10. An image forming apparatus comprising:

image carrying means for carrying an image;

exposing means for exposing a plurality of exposure positions on the image carrying means;

driving means for driving the image carrying means to rotate;

a first meshing member positioned to rotate coaxially and unitarily with the image carrying means;

a second meshing member positioned to convey a drive force generated by the driving means to the first meshing member by one of a direct meshing engagement with the first meshing member and a timing belt spanned around the first and second meshing members; and at least one pair of meshing members positioned to convey the drive force generated by the driving means to the second meshing member, the at least one pair of meshing members connecting to each other by one of a direct meshing engagement and a second timing belt, wherein the first meshing member has a plurality of teeth between first and second exposure positions of the plurality of exposure positions, the plurality of teeth on the first meshing member has a number of teeth which is an integer multiple of a number of teeth on the second meshing member, the first and second meshing members have numbers of teeth whose ratio is an integer, and the meshing members of the at least one pair have numbers of teeth whose ratio is an integer.

11. The image forming apparatus according to claim 10, wherein the second meshing member conveys the drive force generated by the driving means to the first meshing member by the direct meshing engagement with the first meshing member, and the first and second meshing members comprise gears.

12. The image forming apparatus according to claim 11, wherein the gears comprise helical gears.

13. The image forming apparatus according to claim 10, wherein the second meshing member conveys the drive force generated by the driving means to the first meshing member by the timing belt, and the first and second meshing members comprise pulleys.

14. The image forming apparatus according to claim 10, wherein:

the at least one pair of meshing members include a third meshing member positioned to rotate coaxially and unitarily with the second meshing member and a fourth meshing member positioned to mesh with the third meshing member to convey the drive force generated by the driving means to the third meshing member;

the third and fourth meshing members comprise gears;

the second meshing member conveys the drive force generated by the driving means to the first meshing member by the timing belt; and the third and fourth meshing members have a reduction ratio which is greater than a reduction ratio of the first and second meshing members.

15. The image forming apparatus according to claim 10, wherein:

the second meshing member conveys the drive force generated by the driving means to the first meshing member by the direct meshing engagement with the first meshing member;

the at least one pair of meshing members include a third meshing member positioned to rotate coaxially and unitarily with the second meshing member and a fourth meshing member positioned to convey the drive force generated by the driving means to the third meshing member by a timing belt spanned around the third and fourth meshing members; and the first and second meshing members have a reduction ratio which is greater than a reduction ratio of the third and fourth meshing members.

16. An image forming apparatus comprising:

image carrying means for carrying an image;

exposing means for exposing a plurality of exposure positions on the image carrying means;

driving means for driving image carrying means to rotate;

a first meshing member positioned to rotate coaxially and unitarily with the image carrying means;

a second meshing member positioned to convey a drive force generated by the driving means to the first meshing member via a timing belt spanned around the first and second meshing members; and a tension roller positioned to press against a surface of the timing belt to tension the timing belt, wherein the timing belt has a conveyance distance between the first and second exposure positions, and the conveyance distance is an integer multiple of a peripheral length of the tension roller.

17. The image forming apparatus according to claim 16, wherein:

the first meshing member comprises a pulley; and the conveyance distance is conveyed by one rotation of the first meshing member.

* * * * *